US005416988A

United States Patent [19]

Potter et al.

[11] Patent Number: 5,416,988

[45] Date of Patent: May 23, 1995

[54] CUSTOMIZED FIT SHOE AND BLADDER THEREFOR

[75] Inventors: Daniel R. Potter, Beaverton; Bruce J. Kilgore, Lake Oswego, both of Oreg.

[73] Assignee: Nike, Inc., Beaverton, Oreg.

[21] Appl. No.: 52,282

[22] Filed: Apr. 23, 1993

Related U.S. Application Data

[63] Continuation of Ser. No. 865,664, Apr. 7, 1992, abandoned, which is a continuation of Ser. No. 701,312, May 14, 1991, abandoned, which is a continuation of Ser. No. 416,262, Oct. 3, 1989, abandoned, which is a continuation-in-part of Ser. No. 324,705, Mar. 17, 1989, abandoned.

[51] Int. Cl.[6] ..... A43B 7/14

[52] U.S. Cl. ..... 36/89; 36/91; 36/71; 36/114

[58] Field of Search ..... 36/115, 114, 91, 71, 36/89, 93, 88, 92, 114, 119, 153, 29, 154; 128/80 H

[56] References Cited

U.S. PATENT DOCUMENTS

| | | | |
|---|---|---|---|
| 435,452 | 9/1890 | Richards . | |
| 518,579 | 4/1894 | Annenberg | 36/26 |
| 746,338 | 12/1903 | Keen | 36/71 X |
| 1,069,001 | 7/1913 | Guy | 36/29 |
| 1,254,654 | 1/1918 | Carling | 36/153 |
| 1,313,924 | 8/1919 | Stewart . | |
| 1,364,226 | 1/1921 | Wherry . | |
| 1,375,585 | 4/1921 | Goodwin | 137/231 |
| 1,584,034 | 5/1926 | Klotz | 36/153 |
| 1,605,985 | 11/1926 | Rasmussen . | |
| 1,730,466 | 10/1929 | Mallott . | |
| 1,757,019 | 5/1930 | Mott . | |
| 1,954,122 | 4/1934 | Fiori | 36/71 |
| 2,020,240 | 11/1935 | Cochran . | |
| 2,028,060 | 1/1936 | Gilbert . | |
| 2,086,389 | 7/1937 | Pearson | 36/71 |
| 2,103,108 | 12/1937 | Broecker et al. | 152/12 |
| 2,141,033 | 12/1938 | Crowley | 284/19 |
| 2,150,290 | 3/1939 | Mulvey . | |
| 2,177,116 | 10/1939 | Persichino . | |
| 2,247,961 | 7/1941 | Mulvey . | |
| 2,255,932 | 9/1941 | Kraft et al. | 152/430 |
| 2,276,502 | 3/1942 | McCoy | 277/42 |
| 2,365,807 | 12/1944 | Dialynas | 36/153 |

(List continued on next page.)

FOREIGN PATENT DOCUMENTS

| | | |
|---|---|---|
| 200963 | 12/1958 | Austria . |
| 515639 | 12/1952 | Belgium . |
| 951117 | 7/1974 | Canada . |
| 951118 | 7/1974 | Canada . |
| 40189 | 11/1981 | European Pat. Off. . |
| 0094868 | 11/1983 | European Pat. Off. . |
| 152401 | 8/1985 | European Pat. Off. . |

(List continued on next page.)

OTHER PUBLICATIONS

UK Patent Application 2111821A.

"Pumping Up", Photo and discussion, Footwear News, Apr. 3, 1989, p. 1.

"New Generation", Photos and discussion, Footwear News, Sep. 11, 1989, p. 26.

"Primed To Deliver The Pump", Footwear News, Oct. 2, 1989.

(List continued on next page.)

*Primary Examiner*—Jimmy G. Foster
*Assistant Examiner*—Ted Kavanaugh
*Attorney, Agent, or Firm*—Banner, Birch, McKie & Beckett

[57] ABSTRACT

A customized fit shoe, and particularly a high-top ice hockey skate, having a plurality of interior inflatable chambers. The chambers are configured and inflatable to different amounts to conform to the contours of the arch and the area below the malleoli of the foot in the shoe. The inflation of the chambers is accurately and easily adjusted through an upper push-to-deflate valve. When thereby adjusted, the concavities of the arch and ankle are filled without restricting the plantar or dorsi flexion of the foot.

5 Claims, 7 Drawing Sheets

U.S. PATENT DOCUMENTS

| | | | |
|---|---|---|---|
| 2,439,545 | 4/1948 | Matlas . | |
| 2,531,763 | 11/1950 | Andre | 36/2.5 |
| 2,600,239 | 6/1952 | Gilbert | 36/153 |
| 2,605,560 | 8/1952 | Gouabault . | |
| 2,638,690 | 5/1953 | Bullard | 36/71 |
| 2,663,020 | 12/1953 | Cushman . | |
| 2,686,006 | 8/1954 | Hasselquist . | |
| 2,715,231 | 8/1955 | Marston | 9/17 |
| 2,762,134 | 9/1956 | Town . | |
| 2,774,152 | 12/1956 | Alber | 36/71 |
| 2,830,585 | 4/1958 | Weiss | 128/166 |
| 2,942,359 | 6/1960 | Bushway et al. | 36/8.5 |
| 3,027,659 | 4/1962 | Gianola . | |
| 3,030,640 | 4/1962 | Gosman | 5/349 |
| 3,078,864 | 2/1963 | Schmid et al. | 137/223 |
| 3,081,774 | 3/1963 | Lelyveld . | |
| 3,121,430 | 2/1964 | O'Reilly | 128/595 |
| 3,134,418 | 5/1964 | McConkie | 152/427 |
| 3,186,004 | 6/1965 | Carlini . | |
| 3,273,263 | 9/1966 | Klima . | |
| 3,312,213 | 4/1967 | Timm . | |
| 3,316,663 | 5/1967 | Neu . | |
| 3,372,495 | 3/1968 | Finn | 36/2.5 |
| 3,410,004 | 11/1968 | Finn . | |
| 3,469,576 | 9/1969 | Smith et al. | 128/595 |
| 3,508,572 | 4/1970 | Paffrath | 137/231 |
| 3,537,716 | 11/1970 | Norgiel | 36/115 X |
| 3,659,361 | 5/1972 | White, Sr. | 36/115 X |
| 3,664,043 | 5/1972 | Polumbus, Jr. | 36/71 |
| 3,685,176 | 8/1972 | Rudy | 36/71 |
| 3,716,930 | 2/1973 | Brahm . | |
| 3,744,159 | 7/1973 | Nishimura | 36/2.5 |
| 3,750,310 | 8/1973 | Messner et al. . | |
| 3,758,964 | 9/1973 | Nishimura | 36/119 |
| 3,760,056 | 9/1973 | Rudy | 264/299 |
| 3,854,228 | 12/1974 | Conroy | 36/71 |
| 3,872,511 | 3/1975 | Nichols . | |
| 3,876,746 | 4/1975 | Hanson . | |
| 3,925,916 | 12/1975 | Garbuio | 36/71 |
| 4,035,846 | 7/1977 | Jencks . | |
| 4,067,063 | 1/1978 | Ettinger . | |
| 4,068,323 | 1/1978 | Gwon . | |
| 4,123,855 | 11/1978 | Thedford | 36/153 X |
| 4,126,323 | 11/1978 | Scherz | 36/115 X |
| 4,178,013 | 12/1979 | Bataille . | |
| 4,183,155 | 1/1980 | Payne . | |
| 4,236,725 | 12/1980 | Bataille . | |
| 4,266,298 | 5/1981 | Graziano . | |

(List continued on next page.)

FOREIGN PATENT DOCUMENTS

| | | | |
|---|---|---|---|
| 155495 | 9/1985 | European Pat. Off. . | |
| 221808 | 5/1987 | European Pat. Off. . | |
| 1406610 | 6/1965 | France . | |
| 2144464 | 2/1973 | France . | |
| 2252820 | 8/1976 | France . | |
| 2356384 | 1/1978 | France . | |
| 2407008 | 5/1979 | France . | |
| 2496423 | 6/1982 | France . | |
| 2614510 | 4/1987 | France . | |
| 0181938 | 3/1907 | Germany | 36/153 |
| 2164921 | 10/1972 | Germany . | |
| 2215098 | 5/1973 | Germany . | |
| 2162619 | 6/1973 | Germany . | |
| 2308547 | 8/1974 | Germany . | |
| 2365329 | 11/1974 | Germany . | |
| 2456612 | 6/1975 | Germany . | |
| 3200139 | 5/1982 | Germany . | |
| 3326085 | 7/1983 | Germany . | |

(List continued on next page.)

OTHER PUBLICATIONS

"Nike Takes To The Scale To Win The Weight Test", Footwear News, Jan. 22, 1990.

"Reebok Readies High-Tech Double Pump", Footwear News, Nov. 4, 1991, p. 26.

"Reebok Get Suspension Placed On Spalding Gloves", Footwear News, Jul. 22, 1991, p. 68.

"Reebok Actively Seeking To License Technology", Footwear News, Jul. 22, 1991, p. 66.

L.A. Gear Regulator Ad, Footwear News, Sep. 24, 1990.

L.A. Gear Regulator Ad, Footwear News, Oct. 1, 1990.

"Has Sneaker Madness Gone Too Far?", Newsweek, Dec. 18, 1989.

(List continued on next page.)

U.S. PATENT DOCUMENTS

| | | | |
|---|---|---|---|
| 4,287,613 | 9/1981 | Schulz . | |
| 4,358,902 | 11/1982 | Cole et al. . | |
| 4,361,969 | 12/1982 | Vermonet | 36/88 |
| 4,370,754 | 2/1983 | Donzis . | |
| 4,385,456 | 5/1983 | Livernois et al. | 36/115 |
| 4,423,735 | 1/1984 | Comparetto . | |
| 4,431,003 | 2/1984 | Sztancsik | 36/153 |
| 4,446,634 | 5/1984 | Johnson et al. . | |
| 4,458,429 | 7/1984 | Schmid . | |
| 4,481,970 | 11/1984 | Reid | 137/2235 |
| 4,538,367 | 9/1985 | Adams . | |
| 4,539,764 | 9/1985 | Prodier . | |
| 4,590,691 | 5/1986 | Oliviero . | |
| 4,593,690 | 6/1986 | Sheridan et al. . | |
| 4,631,843 | 12/1986 | Annovi . | |
| 4,662,087 | 5/1987 | Beuch | 36/88 |
| 4,670,995 | 6/1987 | Huang . | |
| 4,702,022 | 10/1987 | Porcher . | |
| 4,712,316 | 12/1987 | Baggio . | |
| 4,719,670 | 1/1988 | Kurt . | |
| 4,724,627 | 2/1988 | Sisco | 36/71 X |
| 4,730,403 | 3/1988 | Walkhoff . | |
| 4,730,610 | 3/1988 | Graebe . | |
| 4,739,813 | 4/1988 | Pagani | 152/427 |
| 4,744,157 | 5/1988 | Dubner | 36/153 X |
| 4,756,306 | 7/1988 | Durlee . | |
| 4,763,426 | 8/1988 | Polus et al. . | |
| 4,776,110 | 10/1988 | Shiang . | |
| 4,781,189 | 11/1988 | Vijii-Rosales . | |
| 4,819,685 | 4/1989 | Pagani | 137/223 |
| 4,832,482 | 4/1989 | Lakic . | |
| 4,836,235 | 6/1989 | Pagani | 137/223 |
| 4,852,564 | 8/1989 | Sheridan et al. . | |
| 4,912,861 | 4/1990 | Huang . | |
| 4,916,836 | 4/1990 | Baggio et al. . | |
| 4,921,147 | 5/1990 | Piorier . | |
| 4,927,191 | 5/1990 | Mikol . | |
| 4,936,029 | 6/1990 | Rudy . | |
| 4,949,479 | 8/1990 | Ottieri | 36/119 X |
| 4,955,149 | 9/1990 | Ottieri | 36/89 X |
| 4,962,762 | 10/1990 | Beekil . | |
| 4,991,317 | 2/1991 | Lakic | 36/29 X |
| 4,995,173 | 2/1991 | Spier . | |
| 4,999,932 | 3/1991 | Grim . | |
| 5,015,515 | 5/1991 | Paulin . | |
| 5,158,767 | 10/1992 | Cohen et al. | 36/29 X |
| 5,313,717 | 5/1994 | Allen | 36/153 X |

FOREIGN PATENT DOCUMENTS

| | | | |
|---|---|---|---|
| 3234086 | 3/1984 | Germany . | |
| 3427644A | 1/1986 | Germany . | |
| 3600437 | 7/1987 | Germany . | |
| 11170 | 9/1887 | United Kingdom . | |
| 23547 | 11/1889 | United Kingdom . | |
| 26637 | 7/1897 | United Kingdom . | |
| 0233387 | 9/1925 | United Kingdom | 36/153 |
| 886934 | 5/1961 | United Kingdom . | |
| 939529 | 10/1963 | United Kingdom . | |
| WO85/03623 | 8/1985 | WIPO . | |
| 87/03789 | 7/1987 | WIPO . | |
| 89/10074 | 11/1989 | WIPO . | |
| 90/04323 | 3/1990 | WIPO . | |
| 90/09115 | 8/1990 | WIPO . | |
| WO90/10396 | 9/1990 | WIPO . | |

OTHER PUBLICATIONS

"Now, Running On Empty", Newsweek, Dec. 3, 1990.

Robinson et al., "Systematic Ankle Stabilization and the Effect on Performance", Medicine and Science In Sports and Exercise, vol. 18, No. 6, pp. 625–628, 1986.

"It's Back To The Future", Sportstyle, Mar. 6, 1989.

"Air Pressure From Nike" Ad, USA Today, Oct. 24, 1989.

"Pumped-Up Reebok Runs Fast Break With New Shoe", Wall Street Journal, Dec. 20, 1989.

"From Air To Pump To Puma's Disc System, Sneaker Gimmicks Bound To New Heights", The Wall Street Journal, Oct. 31, 1991, p. B1.

CUSTOMIZED FIT SHOE AND BLADDER THEREFOR

CROSS-REFERENCE TO RELATED APPLICATIONS

This is a continuation of application Ser. No. 07/865,664, filed Apr. 7, 1992, which is a continuation of Ser. No. 07/701,312, filed May 14, 1991, which is a continuation of Ser. No. 07/416,262, filed Oct. 3, 1989, which is a continuation-in-part of application Ser. No. 07/324,705, filed Mar. 17, 1989, all now abandoned, and the entire contents of Ser. No. 07/324,705 are hereby incorporated by reference.

BACKGROUND OF THE INVENTION

The present invention relates to athletic shoes and particularly to high top athletic shoes including high top skates. The invention is further directed to shoes having one or more inflatable chambers therein to provide a customized fit of the shoe to the foot. The present invention further relates to inflatable bladder and valve assemblies for athletic shoes to provide a customized fit of the shoe to the wearer.

Current athletic shoes are a combination of many elements each having specific functions and all of which must work together to support and protect the foot and to provide traction during athletic events. Today's athletic shoes are designed for the demands and requirements of specific sports and to meet the specific characteristics of the user. An athletic shoe is typically comprised of two parts—an upper and a sole. The sole is attached to the bottom of the upper and provides traction, protection and a durable wear surface. The upper snugly and comfortably encloses the foot. In a running or jogging shoe, the upper typically terminates below the ankle bones and has several layers including a weather and wear resistant outer layer of leather or synthetic material, such as nylon, and a soft padded inner liner for foot comfort. Athletic shoes designed for sports requiring the athlete to make sudden and rapid lateral movements, such as in basketball, football, tennis or ice hockey, are designed such that the upper extends up to or above the ankle bones (the medial and lateral malleoli). Such shoes are referred to as three-quarter height or high top shoes.

Obtaining a proper fit around the ankle bones in the three-quarter height and high top athletic shoes has been a problem in the past because the uneven contour around the ankle bones varies from person to person. The typical prior art technique for fitting the upper around the ankle bones lines the ankle portion of the upper with a relatively soft foam material. However, since no two persons have precisely the same ankle bone configuration, the foam material only approximates a customized fit.

Adjustable air inflated bladders in the ankle portion of an upper are also known, and particularly in ski boots wherein the upper is relatively inflexible and the air bladders are designed to embrace the ankle and lower leg and provide a restraining force against the foot. Examples of air bladders used in ski boots are those in West German Patents 2,365,329 and 2,308,547. These air bladders typically form rigid vertical columns along the medial and lateral sides of the foot and leg, thereby restricting movement of the foot. While such restriction of motion is desirable in a ski boot, it interferes with the required foot motion in athletic shoes designed for most other athletic activities.

Examples of other shoes having bladder or similar arrangements include those in U.S. Pat. Nos. 1,313,924, 2,086,389, 2,365,807, 3,121,430, 3,469,576 and 4,361,969, as well as that in French 1.406.610 patent. Some of these designs include bladder placement which actually interferes with the fit of the foot in the shoe, some are not volume or pressure adjustable to provide a customized fit, some interfere with cushioning components of the shoe, some restrict the movement of the foot, and some interfere with the pronation/supination action of the foot. None of them meets today's rigorous athletic standards, and none of them is especially well-suited for use in high top ice skates.

No suitable valves are known which can be easily attached to the bladder and which can be accurately and easily deflated by depressing with a finger tip for accurate and fine adjustment of the pressure. The inflation/deflation system should have a minimum number of parts and be simple, reliable and inexpensive as well as easy to use.

SUMMARY OF THE INVENTION

The present invention is thus directed to athletic shoes and particularly to high top ice skates comprised of a sole and an upper attached to the sole. The upper includes an ankle portion extending around at least a portion of the area of the medial and lateral malleoli. One or more malleoli chambers are positioned in the shoe to fill in the areas below the malleoli. One or more arch chambers are positioned at the arch area in the shoe. Upper heel chambers fill in the areas behind and slightly above the malleoli. Each of these chambers is pressure adjustable through a valve stem accessible from outside the shoe. When inflated these chambers contour to the concavities of the foot adjacent the malleoli and at the arch without restricting the plantar or dorsi flexion of the foot.

A novel valve assembly of this invention allows the pressure in the bladder chambers to be finely adjusted. The valve seat is built into the molded valve housing and has a conical-shaped seat area. The valve stem is biased by a spring to a valve closed position, with the stem flat surface of the stem mating against this seat area. The valve can be opened to accurately release pressure in the bladders by depressing the valve stem with the fingertip. When the sleeve end of the hand pump is fitted around the housing, the radial prongs or cross-bars in the sleeve end of the pump also depress the valve stem opening the valve so that air can be pumped into the bladders by gently squeezing the hand pump. A simple, reliable, accurate and inexpensive valve assembly and hand pump are thereby provided.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof and to the accompanying descriptive matter.

DETAILED DESCRIPTION OF PREFERRED EMBODIMENTS OF THE INVENTION

Figure 1:
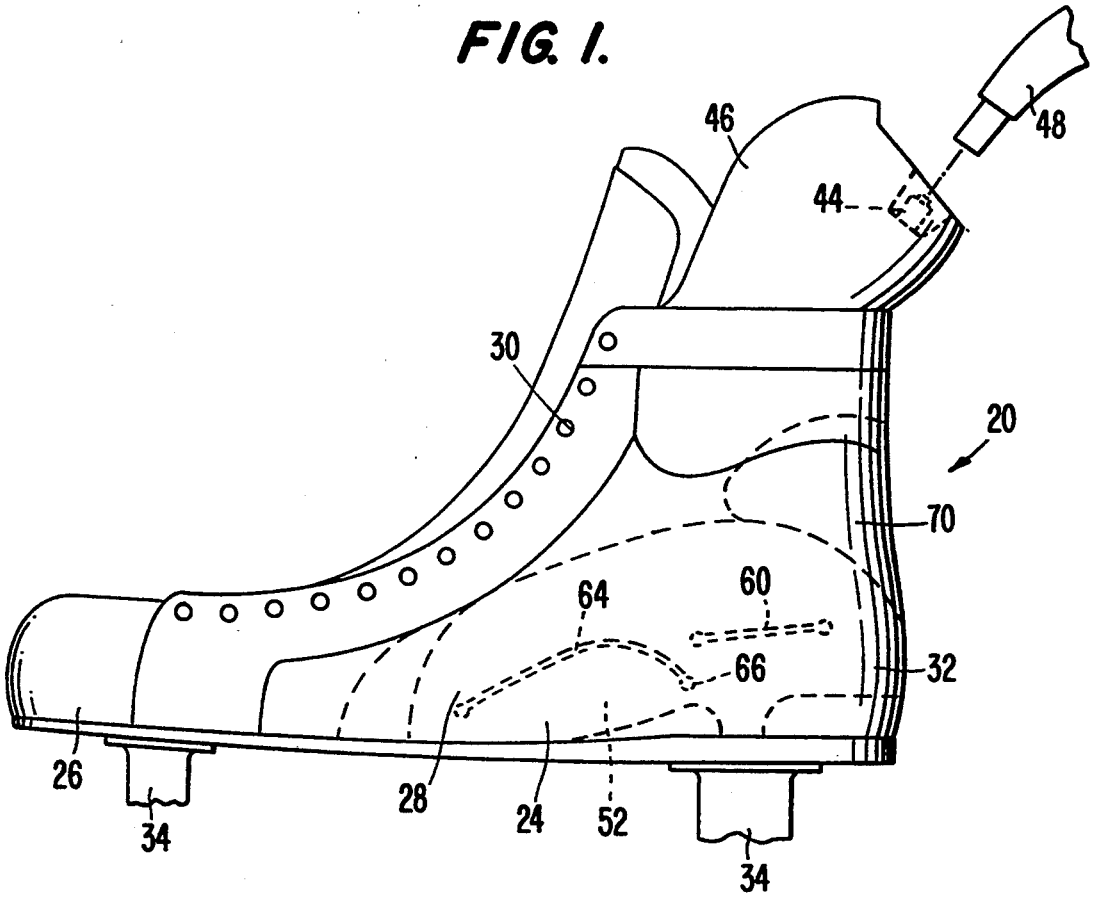
FIG. 1 is a side elevational view of a shoe, particularly a high top ice skate, of the present invention which includes a novel inflatable bladder system.
Figure 2:
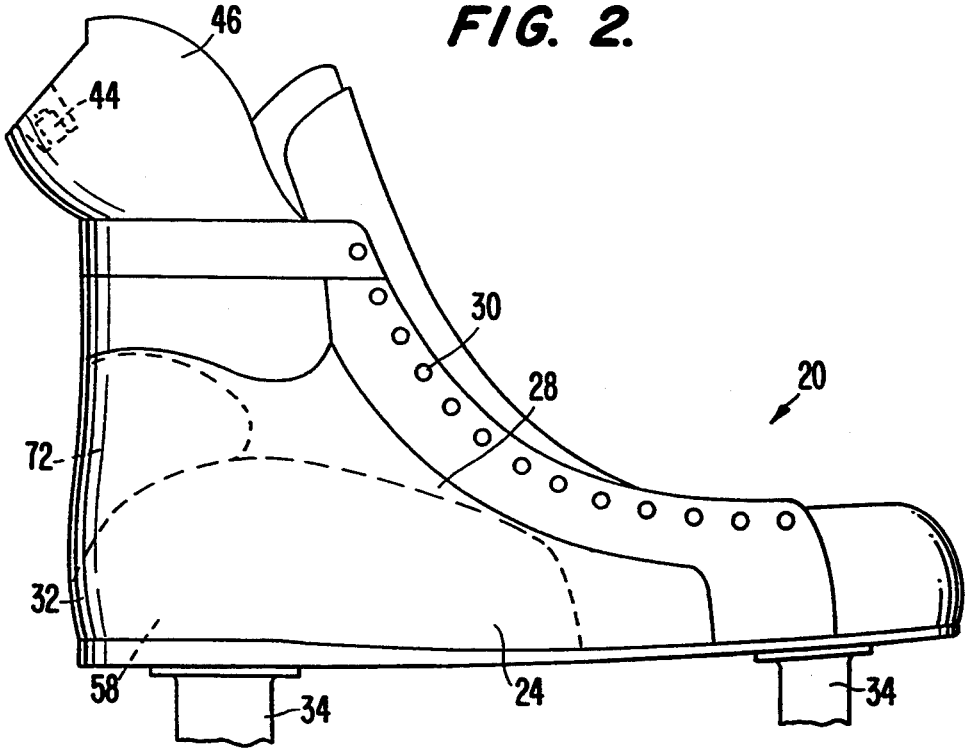
FIG. 2 is a side elevational view of the opposite side of the shoe of FIG. 1.
Figure 3:
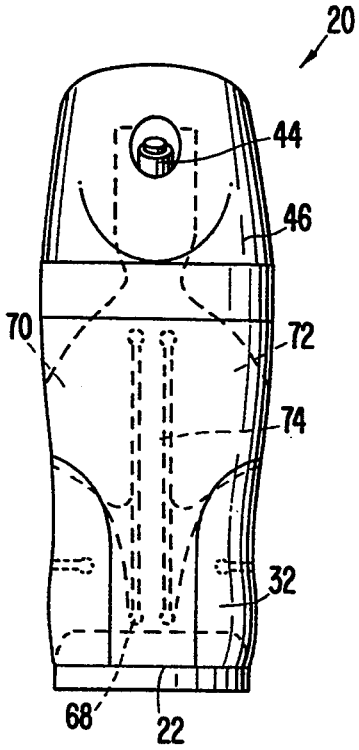
FIG. 3 is a rear elevational view of the shoe of FIG. 1.
Figure 5:
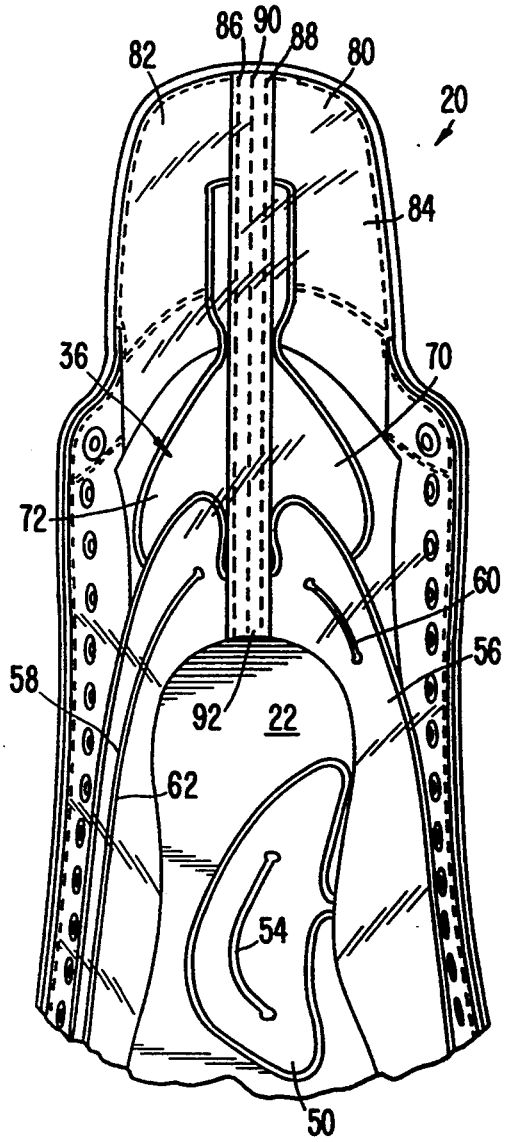
FIG. 5 is a top perspective view of the forward portion of the shoe of FIG. 1 with the tongue pulled forward to more clearly illustrate the bladder system therein.

Referring to the drawings, wherein like numerals indicate like elements, it is best illustrated in FIGS. 1, 2 and 5 an athletic shoe shown generally at 20 in accordance with the present invention. Shoe 20 includes a sole 22 attached in a conventional manner to an upper 24. The shoe 20 is preferably a high top type of athletic shoe wherein the upper 24 extends around and above the medial and lateral malleoli, indicated as M in FIG. 6. The upper 24 includes a toe portion 26 extending around the area of the toes, an instep portion 28 extending around the instep portion of the foot and including lacing eyelets 30, and an ankle portion 32 extending around the ankle and lower leg. A skate blade 34, whose upper portions are depicted in FIGS. 1 and 2, can be secured beneath the sole 22 so that the shoe 20 thereby forms an ice skate.

Figure 6:
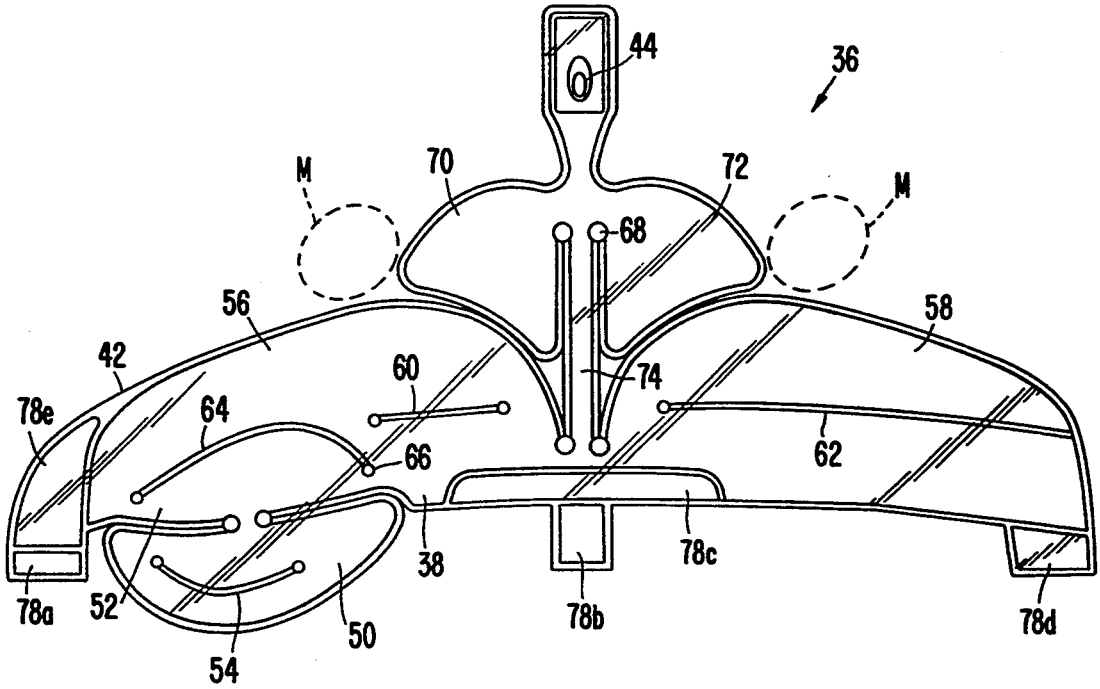
FIG. 6 is a plan view of the inflatable bladder system of the present invention shown extended flat and in isolation.

An inflatable air bladder assembly shown for example in isolation in FIG. 6 generally at 36 is attached inside of the shoe 20 to the upper 24. The bladder assembly 36 is formed of two separate sheets or layers of elastomeric film—an inside layer 38 and an outside layer—which are sealed together along their perimeter edges 42. The air bladder assembly 36 includes a plurality of chambers inflatable to different degrees and positioned to correspond to different concavity areas of the foot. These chambers are connected by air passageways and separated by weld lines, and some are further divided into pockets or subchambers, as will be explained below, to further enhance the fit. Although The chambers are separate and can be inflated to different degrees to accommodate differently configured feet, they are inflatable through the same nozzle or valve stem as shown generally at 44 at the top of the bladder assembly 36. The valve stem 44 can be located, however, at generally any other convenient location on the shoe 20. It is also within the scope of this invention to provide independent valves for one or more of these chambers.

The valve stem 44 extends out the back of the shoe 20 to be accessible from outside of the shoe. A pre-shaped shroud 46 of a relatively high density foam material is secured to the upper 24 at the upper top portion of the shoe 20. The shroud 46 has an aperture therethrough through which the valve stem 44 extends to be accessed for inflation and deflation of the chambers of the bladder assembly 36. Since the shroud 46 is formed of a high density foam material, it takes on a relatively fixed, but flexible configuration. The bladder assembly 36 can be inflated by a hand pump as shown in both the parent '705 application in FIG. 1 at 48 and as will be described later with respect to FIGS. 7 and 13–17. Further details of the push-to-deflate nozzle arrangement of this valve stem 44 and its interaction with the hand pump 48 accompany the disclosure herein relative to FIGS. 8–12. The amount of air and thus pressure in each of the chambers can be finely and accurately adjusted by inflating the bladder assembly 36 through the valve stem 44 by gently squeezing the hand pump 48. Accurate deflation then can be made by lightly pressing as with the finger tip or the opposite end of the hand pump 48 the push-to-deflate nozzle of valve stem 44. In lieu of air, any suitable free-flowing, non-setting fluid can be used to controllably adjust the size and pressure of the chambers.

Figure 4:
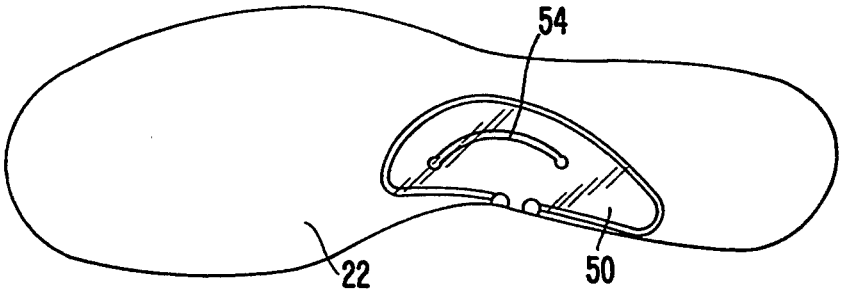
FIG. 4 is a top plan view of the sole of the shoe of FIG. 1 and a portion of the bladder system thereon, illustrated in isolation.

The bladder assembly 36 is divided into a plurality of chambers, as can be seen for example in FIGS. 5 and 6. The arch chamber 50, as can also be seen in FIGS. 1 and 4, has its function augmented by the side arch chamber 52, which is positioned towards the medial side of the foot. These two chambers 50, 52 combine to completely fill in the arch area of the foot. A curved contouring weld 54 centrally positioned in the arch chamber 50 provides an additional contouring fit function. A pair of malleoli or lower heel chambers 56, 58 extend forward to the arch area along the sides of the foot. The malleoli or lower heel chambers 56, 58 are subdivided by contouring welds 60, 62 to provide a contoured filling in of the area of the foot below the malleoli. The heel chamber 56 is separated from the side arch chamber 52 by a contoured weld 64. Weld dots ("posts") are provided at the free ends of the weld lines—either a relatively small dot (post) as shown at 66 or a larger post as shown at 68 for the double or folded layer ends.

Upper heel chambers 70 and 72 for filling in the areas of the foot behind and slightly above the malleoli are provided at the top of the bladder assembly 36 below the valve stem 44. Umbilical passageway or tube 74 extends from the upper heel chambers 70, 72 to the malleoli or lower heel chambers 56, 58. Although this tube 74 is narrow enough to not actually or significantly inflate when the bladder assembly 36 is pressurized, it is wide enough to allow air to pass freely through it thereby communicating the various bladder chambers. The bladder assembly 36 thus fills in the cavities of the arch and ankle of the foot to enhance the fit of the shoe to the foot, rather than to cushion the foot. The bladder assembly 36 does not extend around the entire foot so as to interfere with the fit and particularly does not restrict the plantar and dorsi flexion of the foot. In other words, the numerous chambers within this bladder assembly 36 contour the bladder assembly to the anatomy of the foot without restricting the motion of the foot.

A plurality of tabs 78*a*, 78*b*, 78*c*, 78*d*, and 78*e*, as best shown in FIG. 6, extend out from the chambers for stitching the bladder assembly 36 in place in the shoe 20 to the shoe upper 24, and are not themselves inflated. As seen in FIG. 5, a liner 80, preferably a flexible clear plastic liner, is secured to and in the upper 24 and positioned between the bladder assembly 36 and the foot. This liner 80 allows the foot to be easily slipped into and out of the shoe 20 without dislodging, damaging or getting caught up on any of the chambers of the bladder assembly 36. The liner 80 can be comprised of a pair of flexible sheets 82, 84 stitched along the edges of the upper 24 on both sides thereof. The rear vertical edges of the two sheets 82, 84 are stitched to one or two interconnected elongated webs 86, 88 secured at the top 90 and the bottom 92 of the upper 24 and not fixed along their lengths to the upper 24 so as to not restrict the inflating and deflating movement of the enclosed bladder assembly 36.

Alternatively, this bladder assembly 36 can be molded in place in a polyurethane or latex sockliner or adhered to an EVA or PEEVA liner. Fabric or foam can be applied to the inner surfaces of the chambers to provide slip resistance and comfort to the foot as when a plastic liner is not used. The bladder assembly 36 can be attached to the bottom of a foam sockliner. The heel area and the forefoot area can be left completely exposed to prevent this assembly from interfering with the cushioning of the foot.

Although depicted in use in a high top ice skate, it is within the scope of the present invention to adapt this bladder assembly invention to other athletic shoes having different requirements. For example, the bladder assembly can be adapted for use in a three-quarter height shoe wherein the ankle portion of the upper extends only partially over, or only slightly above the medial and lateral malleoli.

Figure 7:
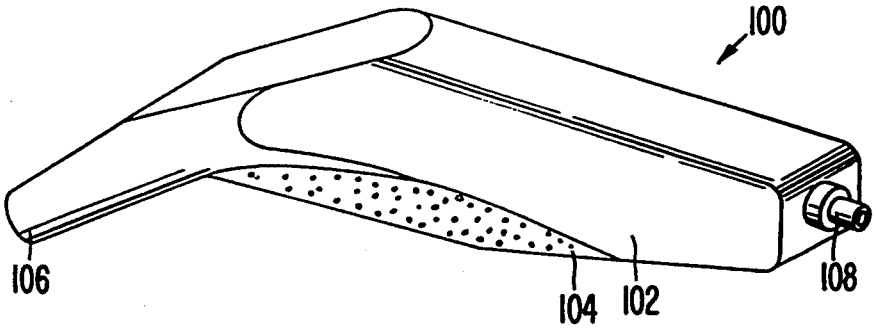
FIG. 7 is a perspective view illustrating in isolation an alternative hand pump of the present invention.

A preferred hand pump of the present invention is illustrated in isolation in FIG. 7 generally at 100. It is seen therein to include a pump body 102 of a flexible plastic material which can be easily grasped and controllably compressed by a hand squeeze and when the pressure of the hand squeeze is released returns to its normal expanded position. The body 102 further includes a bumpy and raised lower surface 104 providing a friction surface to be easily held in the user's hand. When the pump body 102 is compressed, air in the body is expelled or forced out of the outlet end 106. When it is subsequently released, the air is sucked in through the opposite inlet end 108.

Both inlet and outlet ends 108, 106 include internal sliding rods which slide within their nozzle housings between open and closed positions relative to their openings as needed for the pumping action. A sample valve housing for the outlet end 106 and in which the outlet rod slides is shown in isolation in FIGS. 13–15 generally at 110. When released, the outlet plug or rod which is shown at 111 in FIG. 14, is then sucked or drawn inward to a position spaced from the prongs 112 closing the opening. The prongs or cross-bars 112 provide an abutment surface for depressing the valve assembly shown generally at 114 to open it so that air can be injected into the bladder 116. Similarly, the sliding rod of the inlet end 108 slides to an open position when the pump body 102 is released to allow air to be sucked in through the opening. At that time the outlet end 106 is in a closed position by the outlet rod. When the body 102 is compressed, the sliding inlet rod is forced outwardly to close the inlet end 108 so that all of the expelled air pressure is expelled through the outlet end 106.

Figure 8:
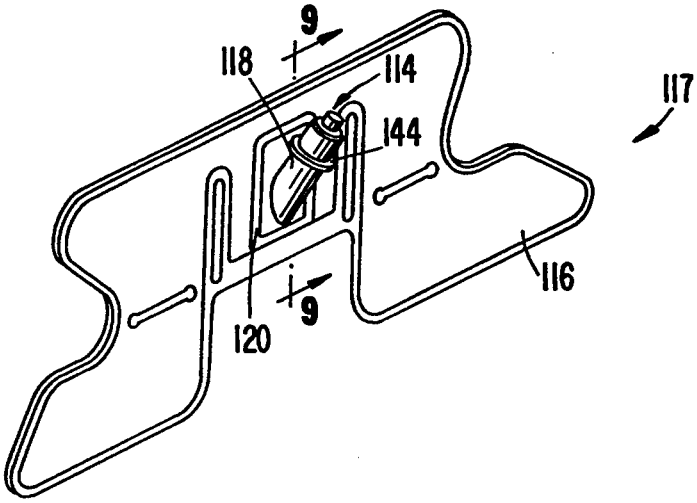
FIG. 8 is a perspective view illustrating in isolation an alternative bladder and valve assembly of the present invention.
Figure 9:
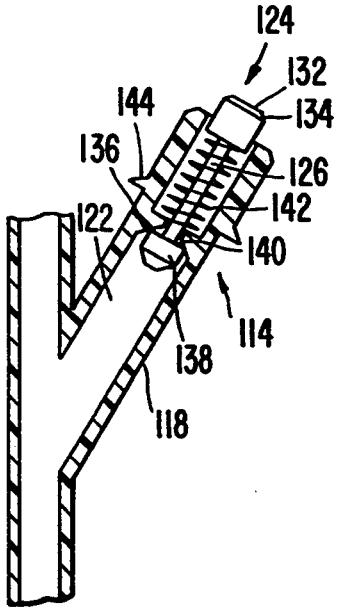
FIG. 9 is a cross-sectional view taken along line 9—9 of FIG. 8.
Figure 10:
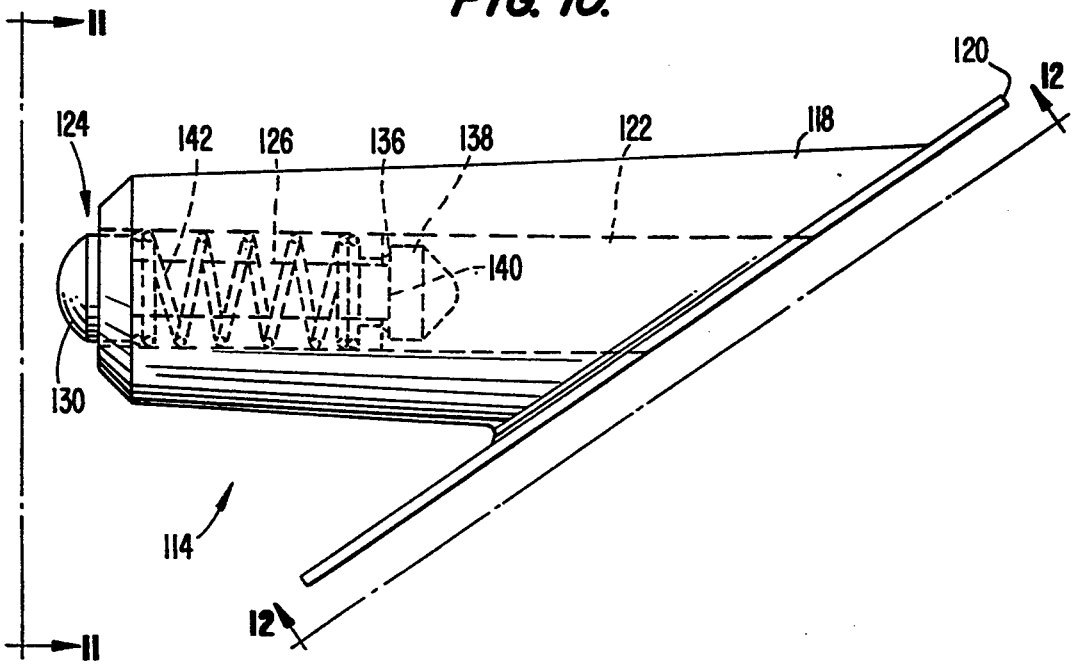
FIG. 10 is a side elevational view of an alternative valve assembly of the present invention which can be used for example on the bladders of FIGS. 6 or 8.
Figure 11:
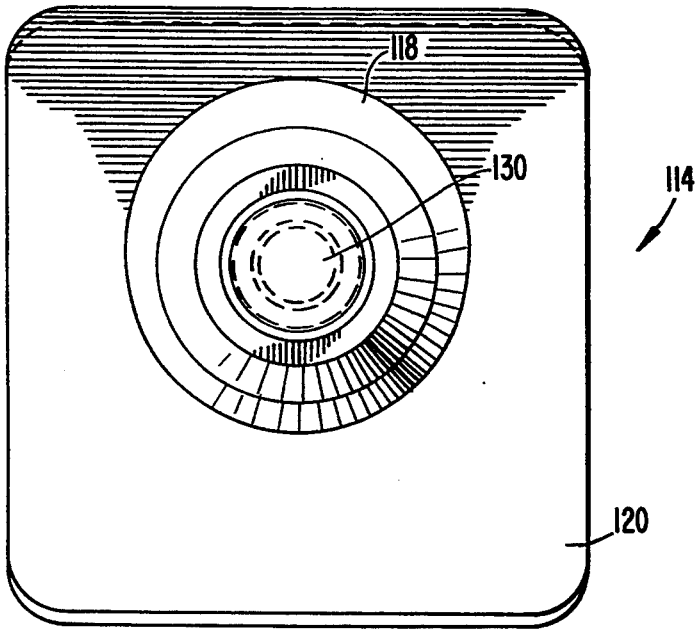
FIG. 11 is a view taken on line 11—11 of FIG. 9.
Figure 12:
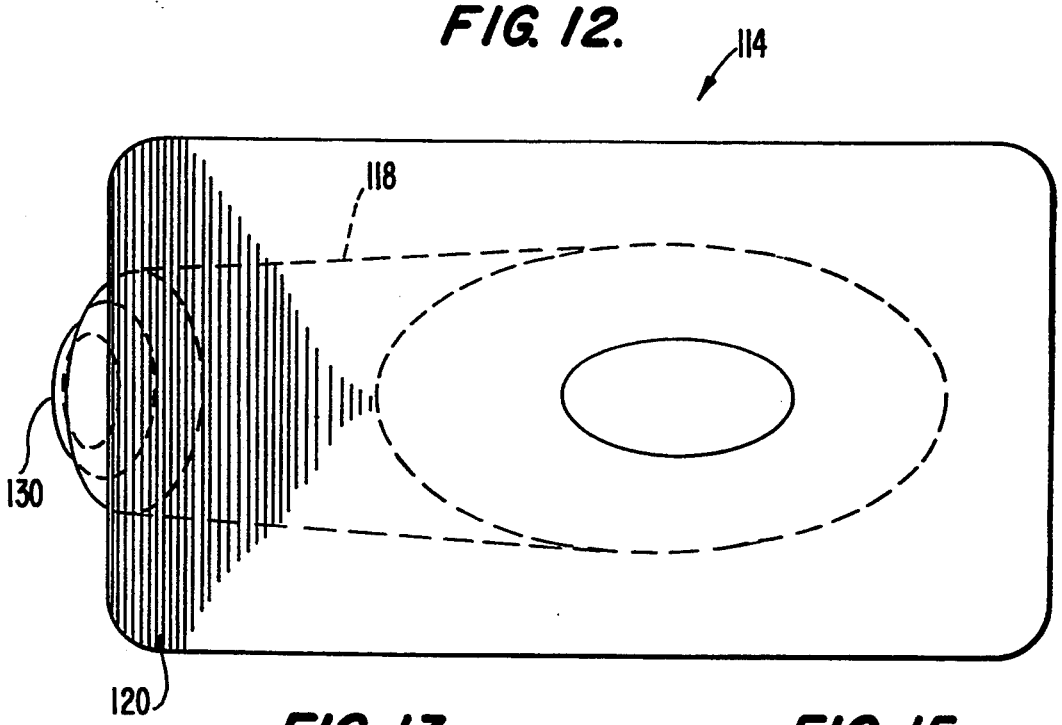
FIG. 12 is a view taken on line 12—12 of FIG. 10.

An alternative bladder and valve assembly of the present invention is shown in FIG. 8 generally at 117. Description of the bladder portion 116 thereof is provided with respect to the embodiment illustrated in FIG. 4 of the parent application. The bladder assembly 36 can of course be substituted therefor. The construction and operation of the valve assembly 114 will now be described with reference to FIGS. 8 and 9 as well as a variation thereon as depicted in FIGS. 10–11, and differences between them will also be mentioned. The valve assembly 114 uses a firm, but compliant, elongated housing 118 of urethane (Shore A80–90) which is compatible with the urethane film bladder 116. This compatibility allows it to be R.F. welded in place along the peripheral flange 120. The housing 118 has an air passageway 122 therethrough and in which is secured a spring-biased valve stem assembly shown generally at 124. This valve stem assembly 124 includes an aluminum valve stem 126 having a broad smooth tip 128 which is easy to manipulate with a finger tip. The tip can either be rounded as shown in FIGS. 10 and 11 at 130 or have a flat surface 132 with a beveled edge 134 as best shown in FIG. 9. The valve body or housing 118 has a conical-shaped seat area 136, and thus the molded valve housing advantageously functions as the valve seat. The inner end of the valve stem 126 defines an enlarged body member 138 having a flat surface 140. This flat surface-conical seat area, in contrast to a conical valve body head, allows for more sealing pressure to be applied and a more compliant spring to be used while still obtaining an adequate seal. This is important when the valve assembly is operated by a person's finger as is the present case.

The spring as shown in FIGS. 8–9 and 10 at 142 encircles the valve stem 126 and can, for example, be a plated music wire compression spring having an outer diameter of 4.57 millimeters, a wire diameter of 0.36 millimeters, a free length of 12.7 millimeters and a spring rate of 0.49 kilograms per millimeter. When the broad smooth tip 128 of the valve stem 126 is manipulated or pressed down with a fingertip or other means, the valve stem is pressed inwardly and the plunger end 138 moved inwardly away from the valve seat 136 allowing air to flow therethrough. The valve assembly 114 of FIGS. 8 and 9, unlike that of FIGS. 10–12, has an annular abutment shoulder 144, against which the end of outlet end 106 abuts when hand pump 100 is slipped into place on valve housing 118 for inflating bladder 116 (or bladder assembly 36), as will be explained in greater detail in conjunction with FIGS. 16 and 17.

Thus, unlike standard freon or push-to-deflate valves which are designed to be held together by a crimped metal housing and then attached to a metal can, the valve of the present invention can be connected to the present urethane film bladder. The standard valve is further difficult and uncomfortable to release pressure from it by using only one's finger tip.

A standard tire or Schraeder valve, which uses a metal pin and rubber gasket assembly inside of a metal housing, has a valve stem which is somewhat easier to depress than is the push-to-deflate-valve. However, the metal housing of this valve is not readily combinable with the present urethane film, unlike the valve of the present invention.

A needle or Voit type of valve requires a needle to be inserted through a rubber stem for inflation and deflation procedures. This type of valve is difficult, however, to manipulate when a fine adjustment of pressure is desired, such as is required in the present footwear application. It is also difficult to regulate the amount of air released by the needle valve from the inflated object inasmuch as that valve is either fully closed or fully open. The needle valve, however, can be made in the material suitable for bonding or welding to a urethane bladder.

One way or check valves which allow flow in only one direction are commonly found in medical devices such as syringes and bulb pumps. A typical check valve has a hard outer housing of metal and plastic and a softer, rubber-like component which seals the valve when air pressure pushes against it. These valves, however, are not suitable for the present purposes since they cannot release air slowly and accurately and they act in only one direction.

Figure 13:
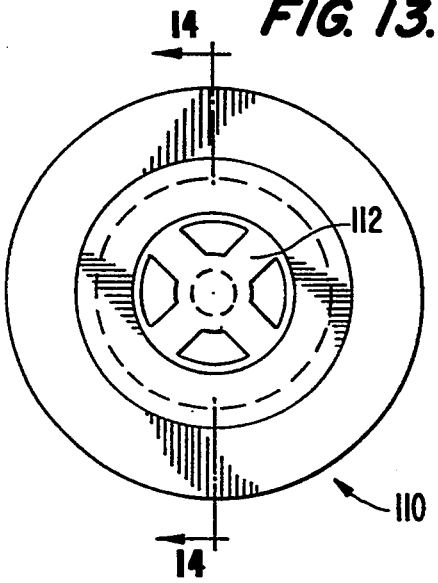
FIG. 13 is an interior end view of a pump nozzle of the hand pump of FIG. 7.
Figure 15:
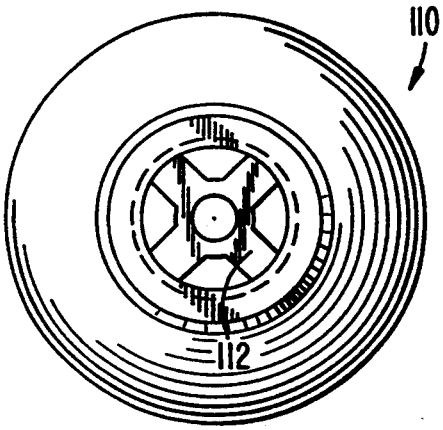
FIG. 15 is an end view of the opposite end of the nozzle of FIG. 7.
Figure 14:
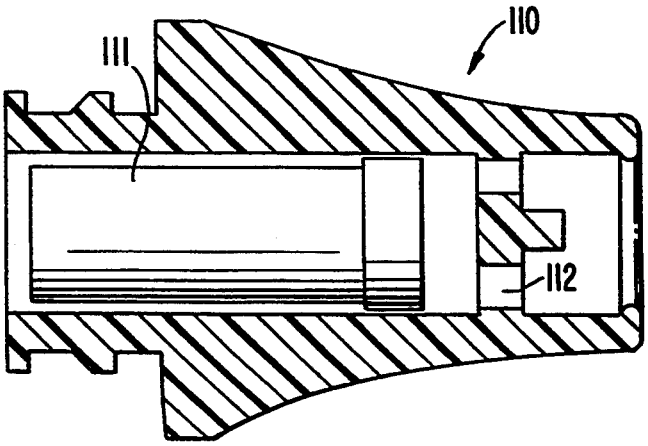
FIG. 14 is a cross-sectional view taken along line 14—14 of FIG. 13.
Figure 16:
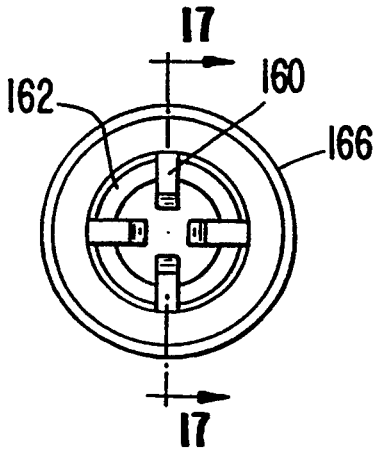
FIG. 16 is an end view of an alternative preferred outlet for the hand pump of FIG. 7.
Figure 17:
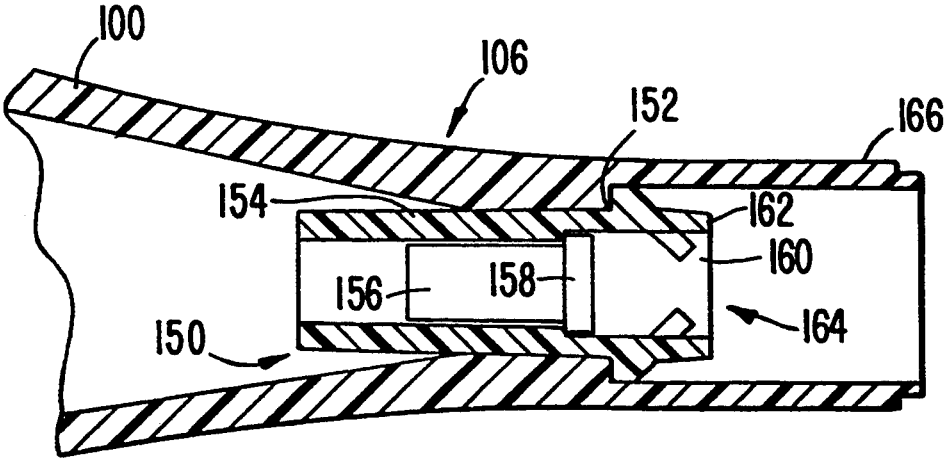
FIG. 17 is a cross-sectional view taken along line 17—17 of FIG. 16 of an alternative preferred outlet end for the hand pump of FIG. 7.

FIGS. 13–15 illustrate one outlet nozzle of the present invention having a connector end (at the left of FIG. 14) adapted to be attached to the body of the hand pump 100. An alternative and preferred outlet nozzle arrangement is illustrated in FIGS. 16 and 17. These two figures show the outlet end 106 of the hand pump 100 with a nozzle 150 built therein against interior pump shoulder 152. The nozzle 150 defines a cylinder in which plug 156 slides. When in an outward position the head 158 of plug 156 engages the four cross prongs 160. The cross prongs 160 extend radially inward and also angle outward relative to the axis of the cylinder 154 as can be understood from FIGS. 16 and 17. The prongs 160 and the distal end 162 of the cylinder define a seat 164. When the sleeve end 166 of the outlet end 106 is slipped onto and over the elongated housing 118 generally up to the abutment shoulder 144, the seat 164 impacts the tip 128. The valve stem assembly 124 is thereby depressed and the valve assembly 114 opened so that air can be injected by the hand pump 100 into the bladder 116 or the bladder assembly 36.

Thus, the valve and pump system of the present invention is advantageous over the prior art systems because of the reduced number of parts needed. No connectors, extenders or the like are required, and no connecting hose between the pump and the valve is needed since the one-way valve in the nozzle of the pump actuates the valve. A perfect air-tight seal therebetween is not necessary since the pressures and volumes involved are quite small as can be appreciated. Since the system has few moving parts, it is very reliable. Inflation and deflation of the bladder can be easily and accurately accomplished with with the present system.

Numerous characteristics and advantages of the invention have been described in detail in the foregoing description with reference to the accompanying drawings. However, the disclosure is illustrative only and the invention is not limited to the precise illustrated embodiments. Various changes and modifications may be affected therein by persons skilled in the art without departing from the scope or spirit of the invention.

What is claimed is:

1. A customized fit shoe for a foot placed therein, the customized fit shoe generally surrounding the heel and lateral and medial malleoli of a foot placed therein, comprising:

a sole;

an upper attached to said sole;

heel chamber means attached to and positioned inside of said upper and inflatable with gas to contour to the area behind and slightly above the malleoli of a foot placed within the customized fit shoe, said heel chamber means including an outer perimeter;

malleoli chamber means attached to and positioned inside of said upper and inflatable with gas to contour to the area directly below the malleoli of a foot placed within the customized fit shoe, said malleoli chamber means including an outer perimeter;

valve means accessible from outside of said upper for adjusting the gas pressure in said heel chamber means and said malleoli chamber means to provide a customized fit for a foot placed within the customized fit shoe;

said heel chamber means being formed of layers of elastomeric material connected around the outer perimeter of said heel chamber means to define medial and lateral heel chambers, said medial and lateral heel chambers each thus including an outer perimeter defined by the connection of said layers of elastomeric material;

said malleoli chamber means being formed of layers of elastomeric material connected around the outer perimeter of said heel chamber means to define medial and lateral malleoli chambers, said medial and lateral malleoli chambers each thus including an outer perimeter defined by the connection of said layers of elastomeric material, a portion of the outer perimeters of said medial heel and malleoli chambers being adjacent to and separate from one another, and a portion of the outer perimeters of said lateral heel and malleoli chambers being adjacent to and separate from one another, to thereby prevent the formation of restrictive columns of pressurized gas between adjacent heel and malleoli chambers.

2. The customized fit shoe of claim 1 wherein said upper includes a heel area, said medial and lateral heel chambers are positioned behind and slightly above the medial and lateral malleoli of a foot placed within the customized fit shoe, and said medial and lateral malleoli chambers are positioned below the medial and lateral malleoli of a foot placed within the customized fit shoe, and further comprising a passageway positioned in the heel area of said upper, said passageway positioned between said medial heel and malleoli chambers and said lateral heel and malleoli chambers to provide fluid communication between said heel chamber means and said malleoli chamber means, said passageway having a width sufficient to allow gas to pass freely through said passageway but insufficient to inflate said passageway significantly whereby an inflated chamber does not impinge on the area at the back of the heel of a foot placed within the customized fit shoe.

3. The shoe of claim 1 further comprising a non-inflatable air passageway through which air passes between said heel chamber means and said malleoli chamber means.

4. A custom-fit shoe for a foot placed therein, the custom-fit shoe generally surrounding an arch area of a foot placed therein, the arch area of the foot being located on the medial side of the foot and including a side surface and a plantar surface wherein the plantar surface defines a plantar surface perimeter, comprising:

a sole;

an upper attached to said sole and generally defining therewithin a shoe interior, said upper including a medial side;

arch chamber means generally in said shoe interior and inflatable with gas to contour to the arch area of a foot placed within said shoe interior, said arch chamber means including a side arch chamber positioned generally adjacent said upper along the medial side of said upper and along the side surface of the arch area of a foot placed within said shoe interior and an arch chamber lying generally on said sole and having a perimeter generally following the perimeter of the plantar surface of the arch area of a foot placed within said shoe interior, said arch chamber being partially separated from said side arch chamber in an area of the custom-fit shoe between the sole and the upper and in fluid communication with said side arch chamber, said side arch and arch chambers together contouring the custom-fit shoe to the entire arch area of a foot placed within said shoe interior, including said side and plantar surfaces; and valve means for adjusting the gas pressure in said side arch chamber means to provide a custom fit in the arch area of a foot placed within said shoe interior;

wherein said side arch chamber is defined by a contouring weld which further contours the fit of said side arch chamber to the side surface of the arch area of a foot placed within said shoe interior, wherein said arch chamber includes a contouring weld in its interior area which further contours the fit of said arch chamber to the plantar surface of the arch area of a foot placed within said shoe interior, and wherein said contouring welds are substantially curved such that the concave surfaces of said contouring welds are disposed towards said area of the custom-fit shoe between the sole and the upper where said arch chamber is partially separated from said side arch chamber.

5. The custom-fit shoe of claim 4 wherein said valve means comprises a valve positioned generally centrally high on the back of said upper.

* * * * *